United States Patent [19]

Guangchun et al.

[11] Patent Number: 4,885,073

[45] Date of Patent: Dec. 5, 1989

[54] ACTIVATED CARBON ANODE INCLUDING LITHIUM

[75] Inventors: Yao Guangchun; Qiu Zhuxian, both of Shenyang; Nu Z. Wu, Shandong, all of China

[73] Assignees: Northeast University of Technology, Liao; Shandong Aluminum Works, Shandong, both of China

[21] Appl. No.: 292,383

[22] Filed: Dec. 30, 1988

[30] Foreign Application Priority Data

Jan. 6, 1988 [CN] China ..... 88100103

[51] Int. Cl.[4] ..... C25C 7/00; C25C 3/12

[52] U.S. Cl. ..... 204/291; 204/67; 204/243 R; 204/294; 373/88; 373/89

[58] Field of Search ..... 204/291, 294, 67, 243 R; 373/88, 89; 313/327

[56] References Cited

U.S. PATENT DOCUMENTS 4,011,374 3/1977 Kaun ..... 429/223

*Primary Examiner*—John F. Niebling
*Assistant Examiner*—Kathryn Gorgos
*Attorney, Agent, or Firm*—Felfe & Lynch

[57] ABSTRACT

This invention relates to a lithum-containing carbon anode employed in the process of producing aluminum metal where the lithium compounds in an amount of 0.1 to 1.5 percent by weight were added into the carbon mass made of pitch and calcined coke to produce a Soderberg anode and carbon mass of prebaked anode. Compared with the ordinary carbon anode used in the production of aluminum, the anode overvoltage will be reduced about 100 to about 200 mV. Therefore, the energy consumption will be decreased by about 300 to about 600 Kwh. In addition, the current efficiency will be increased by 1 to 2 percent.

6 Claims, No Drawings

ACTIVATED CARBON ANODE INCLUDING LITHIUM

BACKGROUND OF THE INVENTION

This invention relates to the field of electrolytic production of aluminum in a cryolite-alumina melt, more particularly, to an activated lithium-containing carbon anode used for producing aluminum metal.

At the present, alumina as raw material is usually dissolved in the molten cryolite, and aluminum metal is produced from the cryolite-alumina melt during the electrolytic process. The anode used in the industrial or commercial production is made of carbon. Unfortunately, it has happened that an anode overvoltage on said carbon anode is shown about 400–600 mV due to the slowness of the reaction between oxygen ions and said anode. This anode overvoltage amounts up to 9–14% of the electrolytic bath voltage and causes a high consumption of electrolytic energy during the production of aluminum.

In the prior art, lithium compounds are usually added directly into the electrolyte to improve the properties of the electrolyte, thus elevating the electric current efficiency. However, the method of adding lithium into the electrolyte brings about significant amount of loss of lithium compound and especially the loss of volatilization from the electrolyte. At the same time, lithium compounds can not be distributed homogeneously in said electrolyte.

The objective of this invention is to provide an activated carbon anode having the different components from the ordinary anode, which can decrease the anode overvoltage, and characterized by lithium present in the anode.Thus lithium compounds will be dissolved slowly and evenly in the electrolyte as the carbon anode is consumed. Not only can the properties of electrolyte be improved, but also the electric current effeciency can be increased and disadvantages of the prior art in the industrial production of aluminum metal can be eliminated.

SUMMARY OF THE INVENTION

According to the present invention, an activated carbon anode including a Soderberg anode and the prebaked anode employed in the process of electrolytic preparation of aluminum comprises a lithium compound and carbonaceous materials. Said lithium compound includes lithium carbonate, lithium oxide, lithium fluoride and lithium hydroxide. Said carbonaceous materials include calcined petroleum coke, pitch coke and pitch and the like.

The process for preparing the activated carbon anode comprises adding the lithium compound into the molten mass which is then mixed well with coke to produce the Soderberg anode and prebaked anode.

DETAILED DESCRIPTION OF THE INVENTION

The activated carbon anode provided in the present invention comprises lithium compounds and carbonaceous materials. Said lithium compounds include lithium carbonate, lithium oxide, lithium fluoride and lithium hydroxide. Said carbonaceous materials comprise calcined petroleum coke, pitch coke, a mixture of calcined petroleum coke and pitch coke and pitch and the like. According to the invention the amount of lithium compound added in the anode mass generally will be an amount that will provide from 0.1 to 1.5 weight percent of the total weight of the carbon anode based upon the corresponding weight of lithium carbonate. Preferably, the amount of lithium compound employed in the anode mass will be an amount sufficient to provide from 0.4 to 0.8 weight percent of the total weight of the carbon anode based upon the corresponding weight of lithium carbonate. Said Soderberg anode comprises from 0.1 to 1.5 weight percent of lithium compound based upon the corresponding weight of lithium carbonate being employed, from 24 to 30 weight percent of coal pitch, and from 68.5 to 75.9 weight percent of a component selected from the group consisting of the calcined petroleum coke, pitch coke and a mixture of calcined petroleum coke and pitch coke, of the total weight of the Soderberg anode. The prebaked anode in the present invention comprises from 0.1 to 1.5 weight percent of lithium compound based upon the corresponding weight of lithium carbonate, from 17 to 22 weight percent of coal pitch and from 76.5 to 82.9 weight percent of a component selected from the group consisting of the calcined petroleum coke, pitch coke and a mixture thereof, of the total weight of said prebaked anode.

The amount of the lithium compound in the above-mentioned prebaked anode being baked will range from 0.11 to 1.7 weight percent calculated as the corresponding weight of lithium carbonate.

The process for preparing the activated carbon anode in accordance with this invention is to add the lithium compound into the molten coal pitch to form a mixture, then mixing the mixture with the calcined coke to produce a fused mass. After being mixed thoroughly in predetermined time, the fused mass as a prepared anode is directly added into a conventional Soderberg cell. The anode mass which is prepared by the above-mentioned process is subjected to press and bake by means of press machine or vibrator and baked to form a prebaked anode. The baking temperature will range from about 1050° C. to about 1250° C. for the manufacture of the activated prebaked anode. According to the present invention, lithium compounds can be evenly distributed within the activated carbon anode and on the surface of said anode.

The lithium-containing activated carbon anode will have higher activity in chemical reaction as compared with the ordinary anode during the process of preparing aluminum by the electrolytic method, thus accelerating reaction rate of oxgen ions and carbon with the result of reducing the overvoltage of the anode employed in the commercial production of aluminum.

With the addition of lithium compounds to the fused anode mass, there is no significant disadvantageous influences on the electric conductivity, mechanical strength and electrolytic consumption of said anode. During the commercial electrolytic production of aluminum, said carbon anode shows a high stability and has a good performance.

The activated carbon anode in the present invention, as compared with the ordinary carbon anode, will reduce the anode overvoltage by about 100 mV to about 200 mV. That is to say, the electrolytic bath voltage can thus be decreased by the value of from 2.5 to 5 percent. Therefore, the energy consumption can be reduced by the value of from about 300 to about 600 Kwh(D.C) when a ton of aluminum is produced. In addition, the lithium compound in the anode will uniformly and slowly dissolves in the cryolite-alumina melt, which can improve the physico- chemical properties of the molten electrolyte and decrease its melting point, by about 10° C. to about 15° C., as well as increase the current efficiency by 1 to 2 percent.

In comparison with the addition of lithium compounds directly into the molten bath in the prior art, the advantages of this invention are as follows:

First, decreasing the anode overvoltage of the carbon anode by about 100 mV to about 200 mV, Second, homogeneously distributing the lithium compound in the carbon anode and in the molten cryolite-alumina bath.

Third, decreasing the mechanical and vaporization loss of lithuim compound during the process of producing aluminum.

The follwing examples are presented to further illustrate the effectiveness of this invention to provide a lithium-containing activated carbon anode.

EXAMPLE 1

The lithium carbonate in the amount of 0.4 percent by weight was added into the Soderberg anode which contained an amount of 28 weight percent of coal pitch and 71.6 weight percent of calcined petroleum coke. The anode overvoltage would be reduced about 150 mV. The energy consumption would be decreased by 500 Kwh (D.C) when a ton of aluminum was produced.

EXAMPLE 2

The lithium carbonate in the amount of 1.5 percent by weight was added into the Soderberg anode which contained an amount of 28 weight percentof coal pitch and 70.5 weight percent of calcined petroleum coke. The anode overvoltage was reduced about 200 mV. The energy consumption was decreased by 600 Kwh (D.C) when a ton of aluminum was produced.

EXAMPLE 3

A prebaked anode comprises an amount of 0.1 weight percent of lithium carbonate, 17 weight percent of coal pitch, 16.6 weight percent of calcined pitch coke and 65.3 weight percent of calcined petroleum coke. Aforesaid materials well mixed were vibrated to form the prepared carbon anode block, which was baked at a temperature of about 1100° C. to about 1200° C. for preparing the prebaked anode. The anode overvoltage indicated for the prebaked anode would be reduced about 80 mV. The energy consumption was decreased by 260 Kwh per ton of aluminum produced.

EXAMPLE 4

A prebaked anode comprises an amount of 0.5 weight percent of lithium fluoride based upon the corresponding weight of lithium carbonate, 17 weight percent of coal pitch and 82.5 weight percent of calcined petroleum coke. The above-mentioned materials well mixed were vibrated to form the prepared carbon block which was baked at a temperature of about 1100° C. to about 1200° C. for preparing the prebaked anode. The anode overvoltage for the prebaked anode employed would be reduced about 150 mV. The energy consumption was decreased by 500 Kwh per ton of aluminum produced.

EXAMPLE 5

A prebaked anode comprises an amount of 1.4 weight percent of lithium oxide based upon the corresponding weight of lithium carbonate, 18 weight percent of coal pitch, 16.1 weight percent of calcined pitch coke and 64.5 weight percent of calcined petroleum coke. The above-mentioned component materials well mixed were vibrated to form the prepared carbon anode block which was baked at a temperature of about 1100° C. to about 1200° C. for preparing the prebaked anode. The anode overvoltage shown for this anode employed was reduced about 170 mV. The energy consumption was decreased by 550 Kwh per ton of aluminium produced.

While the invention is decribed in respect to what at present are the preferred embodiments thereof, it will be understood that changes, substitutions, modifications and the like, can be made therein without departing from its true scope as defined in the appended claims.

What is claimed is:

1. In an aluminum electrolysis cell for the electrolytical production of aluminum, an activated carbon anode including at least one of the group consisting of a Soderberg anode and a prebaked anode comprising:

0.1–1.5% lithium compound by weight based upon the corresponding weight of lithium carbonate;

17–30% coal pitch by weight; and 68.5–82.9% coke by weight.

2. The activated carbon anode as claimed in claim 1, wherein said lithium compound includes lithium carbonate, lithium oxide, lithium fluoride and lithium hydroxide.

3. The activated carbon anode as claimed in claim 2, wherein the preferable amount of lithium compound added in the anode is an amount that provides from 0.4 to 0.8 weight percent of the total weight of the carbon anode based upon the corresponding weight of lithium carbonate.

4. The activated carbon anode as claimed in claim 1, wherein Said Soderberg anode comprises from 0.1 to 1.5 weight percent of lithium compounds based upon the corresponding weight of lithium carbonate, from 24 to 30 weight percent of coal pitch and from 68.5 to 75.9 weight percent of a component selected from the group consisting of the calcined petroleum coke, pitch coke, and a mixture of the calcined petroleum coke and pitch coke, of the total weight of the Soderberg anode.

5. The activated carbon anode as claimed in claim 1, wherein the prebaked anode comprises from 0.1 to 1.5 weight percent of lithium compound based upon the corresponding weight of lithium carbonate, from 17 to 22 weight percent of coal pitch and from 76.5 to 82.9 weight percent of a component selected from the group consisting of the calcined petroleum coke, pitch coke, and a mixture of the calcined petroleum coke and pitch coke, of the total weight of said prebaked anode.

6. The activated carbon anode as claimed in claim 5, wherein the amount of lithium compound in the prebaked anode is baked in the range from 0.11 to 1.7 weight percent calculated as the corresponding weight of lithium carbonate.

* * * * *